US007648059B2

(12) United States Patent
Pavlu, Jr. et al.

(10) Patent No.: US 7,648,059 B2
(45) Date of Patent: Jan. 19, 2010

(54) EXPANDABLE PIÑATA

(75) Inventors: Robert R. Pavlu, Jr., Overland Park, KS (US); Wong Chi Chiu, New Territories (CN); Cheung Siu Chun, New Territories (CN)

(73) Assignee: Hallmark Cards, Incorporated, Kansas City, MO (US)

( * ) Notice: Subject to any disclaimer, the term of this patent is extended or adjusted under 35 U.S.C. 154(b) by 776 days.

(21) Appl. No.: 10/889,664

(22) Filed: Jul. 12, 2004

(65) Prior Publication Data

US 2006/0006214 A1 Jan. 12, 2006

(51) Int. Cl.
*B65D 25/34* (2006.01)

(52) U.S. Cl. ..... 229/116.1; 446/5

(58) Field of Classification Search ..... 428/7, 428/8, 9; 446/5, 4; 403/322.3; 493/223; 229/116.1; 383/127
See application file for complete search history.

(56) References Cited

U.S. PATENT DOCUMENTS

| | | | | |
|---|---|---|---|---|
| 1,335,128 | A | | 3/1920 | Richards |
| 2,147,676 | A | | 2/1939 | Shoemaker |
| 3,565,325 | A | | 2/1971 | Pugsley |
| 3,661,319 | A | | 5/1972 | Koehler |
| 3,702,675 | A | * | 11/1972 | Bajo ..... 446/5 |
| 3,829,003 | A | | 8/1974 | Dilot |
| 4,015,363 | A | | 4/1977 | Sedlak |
| 4,015,364 | A | | 4/1977 | Oquita |
| 4,089,417 | A | | 5/1978 | Osborne |
| 4,166,567 | A | | 9/1979 | Beach, Jr. et al. |
| 4,167,078 | A | | 9/1979 | Oquita |
| 4,185,764 | A | | 1/1980 | Cote |
| 4,186,514 | A | | 2/1980 | Oquita |
| 4,253,266 | A | * | 3/1981 | Bajo ..... 446/5 |
| 4,267,955 | A | | 5/1981 | Struble |
| 4,418,861 | A | | 12/1983 | McFarland et al. |
| 4,453,665 | A | | 6/1984 | Roccaforte et al. |
| D290,976 | S | | 7/1987 | Bajo |
| 4,787,872 | A | | 11/1988 | Bajo |
| 4,790,714 | A | | 12/1988 | Schnapp |
| 4,793,546 | A | | 12/1988 | Nunn |
| 4,832,337 | A | | 5/1989 | Estrada |
| 4,946,292 | A | * | 8/1990 | Diamond et al. ..... 383/127 |
| 5,009,362 | A | | 4/1991 | Brangle, Jr. |

(Continued)

FOREIGN PATENT DOCUMENTS

| | | |
|---|---|---|
| CA | 490867 | 2/1953 |

(Continued)

OTHER PUBLICATIONS

Instruction Sheet, Hallmark Piñata, 3 pages, believed to be publicly available before Jul. 12, 2004.

(Continued)

*Primary Examiner*—Nathan J Newhouse
*Assistant Examiner*—Christopher Demeree
(74) *Attorney, Agent, or Firm*—Fish & Richardson P.C.

(57) ABSTRACT

A collapsible piñata construction may include two main panels, multiple folding side panels and a mechanism located inside the piñata that expands the piñata into an erected state. In various embodiments, the collapsible piñata may be expanded by a single pull on a string or other member coupled to the expansion mechanism.

17 Claims, 8 Drawing Sheets

U.S. PATENT DOCUMENTS

| | | | | | |
|---|---|---|---|---|---|
| 5,096,751 | A | * | 3/1992 | Duchek | 428/12 |
| 5,242,308 | A | | 9/1993 | Estrada | |
| 5,263,889 | A | * | 11/1993 | Ledonne | 446/5 |
| D351,779 | S | | 10/1994 | Allison | |
| 5,536,194 | A | * | 7/1996 | Larsen et al. | 446/5 |
| 5,542,767 | A | * | 8/1996 | Hedaya et al. | 383/127 |
| 5,562,518 | A | | 10/1996 | Estrada | |
| 5,824,378 | A | * | 10/1998 | Armendariz et al. | 428/7 |
| 6,059,708 | A | * | 5/2000 | Armendariz et al. | 493/223 |
| 6,171,166 | B1 | | 1/2001 | Oquita | |
| 6,354,904 | B1 | | 3/2002 | Grey et al. | |

FOREIGN PATENT DOCUMENTS

| | | |
|---|---|---|
| FR | 2577901 | 2/1985 |
| GB | 27105 | 11/1987 |
| IT | 680779 | 1/1965 |

OTHER PUBLICATIONS

The Packaging Designer's Book of Patterns, Laszo Roth and George L. Wybenga, cover pages, Introductory page and pp. vii, 166, 278, 280, © 1991 by Van Nostrand Reinhold, New York, NY.

Birthday Express Children's Party Catalog, Winter 1997, cover pages and pp. 6 and 18 showing Smiley Face Piñata, Unicorn Pull Piñata, and 18" Cow Piñata.

* cited by examiner

EXPANDABLE PIÑATA

TECHNICAL FIELD

This invention relates to foldably collapsible constructions, and in certain embodiments to expandable piñatas that can be shipped in a collapsed state and expanded prior to use.

BACKGROUND

Piñatas generally consist of a rigid exterior surface surrounding a hollow cavity that can be filled with party favors or treats. Piñatas are made in a variety of forms, shapes and sizes, depending on the themes of the parties for which they are being used, the preferences of the participants, and various other factors. Piñatas are often filled with a variety of items, such as candy, small toys, party favors, gift items, or combinations thereof.

The piñata may be suspended, allowing participants to attempt to dislodge the treats housed within. Participants may do so by striking the piñata with an implement, such as a stick, a bat, or the like. Some piñata embodiments include several strings that participants may pull. In such embodiments, one or more of the strings is connected to a trap door. When the string is pulled, the trap door opens, dislodging the treats from the piñata.

Because piñatas are generally large, hollow, and fragile, shipping them can be expensive. Piñatas are often shipped in larger boxes or other containers to protect the decorations on the exterior surface of the piñata and to prevent the piñata from being crushed during transit.

Due to the size of the piñata, retailers often elect to display only a limited number of models. Given their size, each piñata can take a considerable amount of shelf space. If a retailer decides to dedicate only a fixed amount of shelf or display space to piñatas, only a limited number of piñatas can be fit into the selected display area.

Providing piñatas in an unassembled configuration presents several challenges. Customers may not readily recognize the product because they are accustomed to purchasing assembled, hollow, decorated piñatas. The prospect of assembling the piñata may also be unappealing. Assembly may be time consuming and somewhat complex, which may be particularly undesirable in the context of party preparation. Assembled piñatas may also lack the structural properties of a traditional hollow piñata and thus fracture too readily.

SUMMARY

A collapsible piñata construction may include two main panels, multiple folding side panels and a mechanism located inside the piñata that expands the piñata into an erected state. In various embodiments, the collapsible piñata may be expanded by a single pull on a string or other member coupled to the expansion mechanism.

Certain embodiments may have one or more of the following advantages. Some embodiments may allow the piñata to be shipped in a relatively flat position, thereby reducing shipping costs. Some embodiments may allow users to prepare the piñatas for use with minimal effort. In some embodiments users may prepare the piñata for use by pulling only one handle. Certain embodiments may expand and contract with minimal interference between piñata components. In certain embodiments, the piñata may be constructed in a way that enhances structural rigidity and toughness. In such embodiments, the piñata may be less likely to collapse or fracture prematurely or accidentally during use.

The details of one or more embodiments are set forth in the accompanying drawings and the description below. Other features, objects, and advantages will be apparent from the description and drawings, and from the claims.

DESCRIPTION OF FIGURES

Like reference symbols in the various figures indicate like elements.

DETAILED DESCRIPTION OF ILLUSTRATIVE EMBODIMENTS

FIGS. 1-4 show a piñata 10. The piñata 10 includes a top panel 15 and a bottom panel 20. The top panel 15 and the bottom panel 20 may be constructed of corrugated cardboard, cardstock, polymer, paper, other suitable materials, or combinations thereof. The top panel 15 and the bottom panel 20 are both circular in shape, although they may have any desired shape or contour. For example, the top panel 15 and the bottom panel 20 may take the form of rectangles, squares, ovals, triangles, people, animals, or the like. Piñatas are often used at parties, so the top panel 15 and the bottom panel 20 may advantageously be shaped according to a party's theme. For example, the top panel 15 and the bottom panel 20 may be heart-shaped for a Valentine's Day party or shaped as a birthday cake for a birthday party. Often, children's birthday parties have a particular theme, such as Barbie for girls or NASCAR for boys. In such cases, the top panel 15 and the bottom panel 20 may be shaped as a Barbie doll or a NASCAR car. Ornamentation may be affixed to the top panel 15, the bottom panel 20, or both. Such ornamentation may include ribbons, streamers, tissue paper, text, images, and other suitable decorations.

The top panel 15 and the bottom panel 20 are each generally flat, two-dimensional panels. The top panel 15 and the bottom panel may optionally be three dimensional structures. For example, the top panel 15, the bottom panel 20, or both may be shaped as a cone, a dome, an arch, a pyramid, an inverted v-shaped panel, or other three-dimensional shape. In such embodiments, the three-dimensional shapes may be collapsible, such that they can be pressed flat for shipping and expanded for use. Three-dimensional structures, such as those described above, may be removably affixed to the outer surfaces of the top panel 15 and bottom panel 20. In such embodiments, the three-dimensional structure may be removably affixed to the outer surface of the top panel 15, the bottom panel 20, or both.

Figure 3:
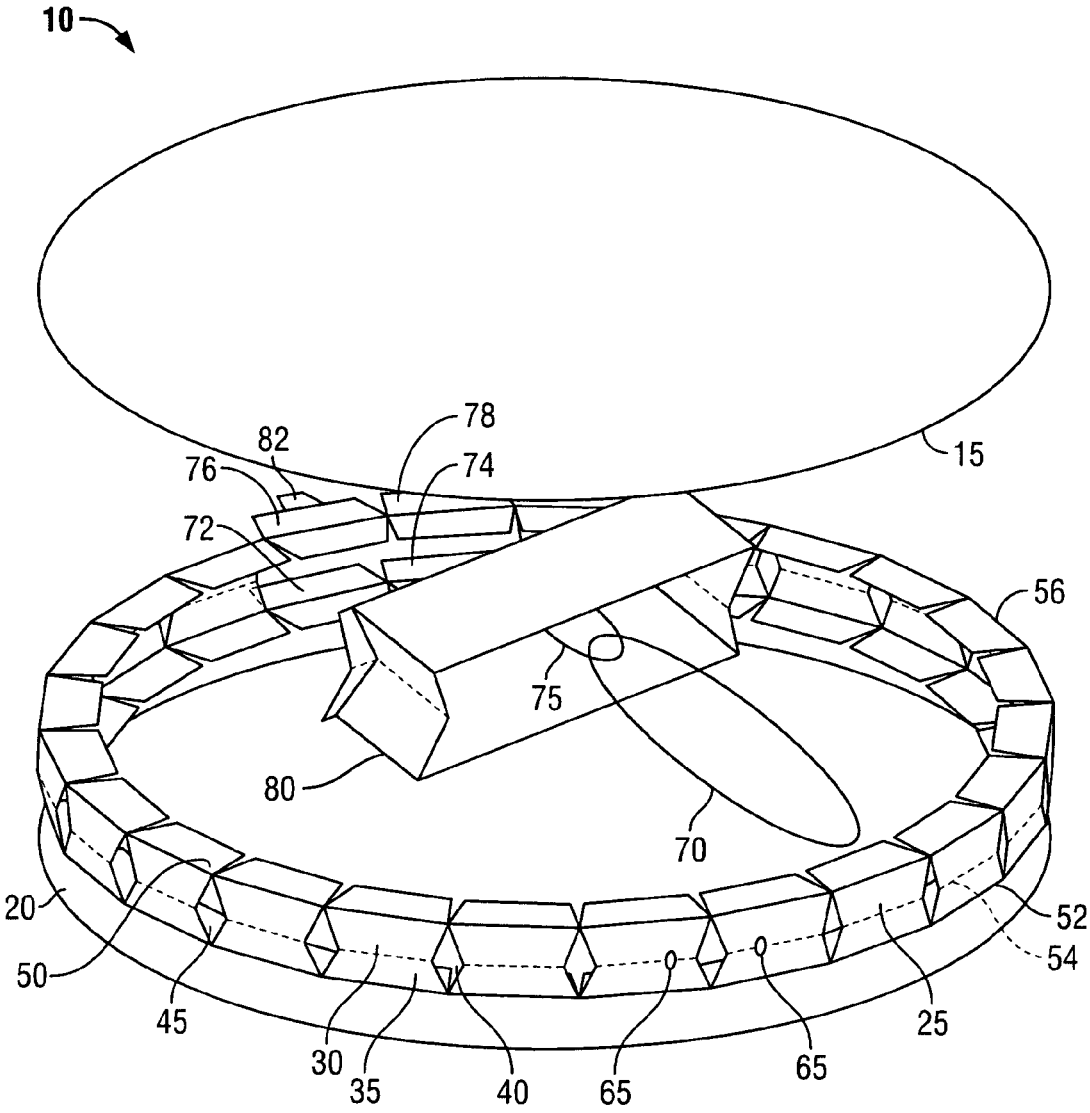
FIG. 3 is an exploded view of the collapsible piñata of FIG. 1.
Figure 5:
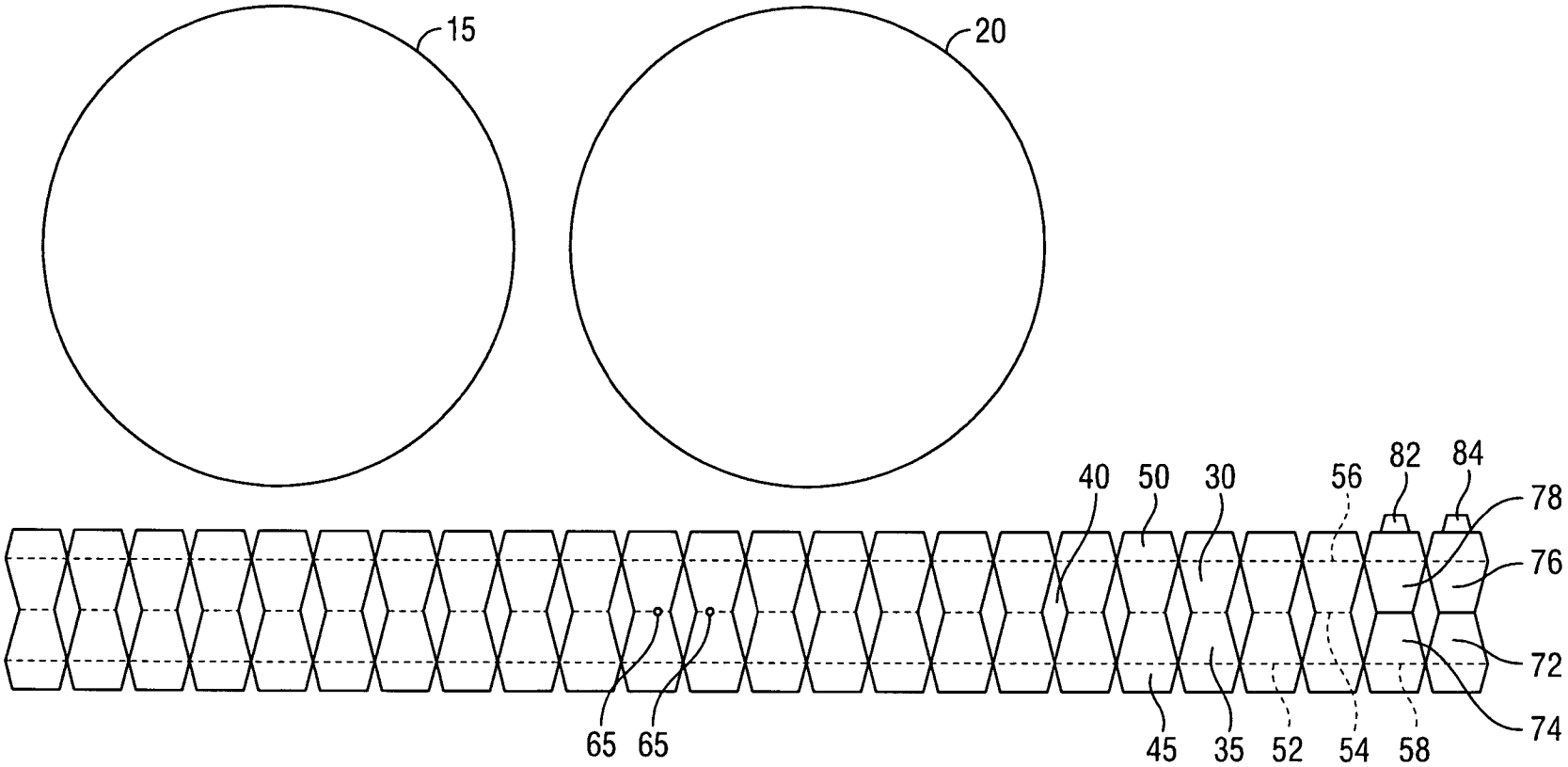
FIG. 5 is a top view of three piñata components.

The top panel 15 is connected to the bottom panel 20 by a plurality of side panels 25. The side panels 25 can be constructed of corrugated cardboard, cardstock, polymer, paper, other appropriate material or combinations thereof. Each side panel 25 may be independent of and disconnected from the other side panels. In some embodiments, as is illustrated in FIGS. 3 and 5, the side panels 25 may be integrally formed of the same material.

Referring again to FIGS. 1-4, each side panel 25 includes a top flap 50 and a bottom flap 45. The top flap 50 is folded inwardly along a top hinge-line 56. The bottom flap 45 is folded inwardly along a bottom hinge-line 52. The top flap 50 and the bottom flap 60 are trapezoidal in shape. The longer parallel edges of the top flap 50 and bottom flap 60 are disposed near the outer edges of the top panel 15 and the bottom panel 20 respectively. The shorter parallel edges of the top flap 50 and the bottom flap 60 are disposed inwardly from the longer respective parallel edges. In some embodiments, multiple top flaps 50 and/or multiple bottom flaps 45 may be included in each side panel 25.

The top flap 50 and the bottom flap 45 may be fastened to the top panel 15 and bottom panel 20 in various ways. For example, the top flap 50 may be fastened to the top panel 15 by adhesive, double-sided tape, staples, or other suitable fasteners. The top flap 50 may be fastened to the top surface of the top panel 15, the bottom surface of the top panel 15, or both. In some embodiments, the top flap 50 may include a tab that tucks into a slot in the surface of the top panel 15. In such embodiments, the tab could be inserted into the top surface of the top panel 15, the bottom surface of the top panel 15, or both. Any of the methods of fastening the top flap 50 to the top panel 15 may be used in combination with each other. Any of the methods of fastening the top flap 50 to the top panel 15 may be used to fasten the bottom flap 45 to the bottom panel 20. In some embodiments, the side panels 25 may be integrally formed with either the top panel 15 or the bottom panel 20. In such embodiments, the side panels 25 may include flaps that fasten to the opposite panel by any of the methods described herein or by any other suitable methods. In some embodiments, some side panels 25 may be integrally formed of the same material with the top panel 15, and some side panels 25 may be integrally formed of the same material with the bottom panel 20. In such embodiments, the side panels 25 may include flaps that fasten to the opposite panel by any of the methods described herein or by any other suitable method.

Each side panel 25 also includes an upper portion 30 and a lower portion 35. The upper portion 30 meets the top flap 50 along the top hinge-line 56. The lower portion 35 meets the bottom flap 45 along the bottom hinge-line 52. The lower portion 35 meets the upper portion along a central hinge-line 54. The upper portion 30 and the lower portion 35 are trapezoidal in shape. The longer parallel edges of the upper portion 30 and the lower portion 35 are disposed along the top hinge-line 56 and bottom hinge-line 52 respectively. The shorter parallel edges of the upper portion 30 and the lower portion 35 meet along the central hinge-line 54.

Figure 1:
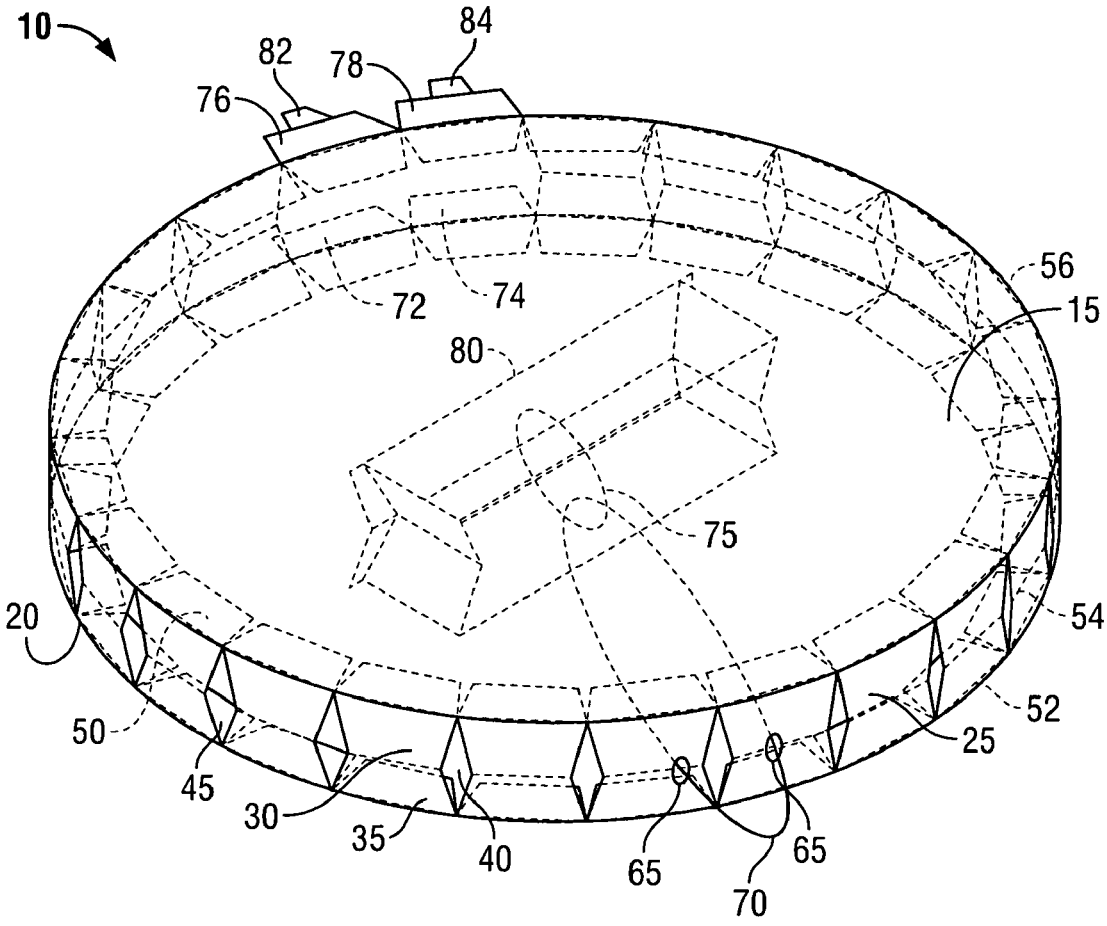
FIG. 1 is a perspective view of a collapsible piñata in an expanded position.

FIG. 1 shows the piñata 10 in an expanded condition. The upper portion 30 and the lower portion 35 are both substantially vertical. In the expanded position, the side panels 25 are unfolded. The distance from the top panel 15 to the bottom panel 20 is roughly equal to the height of the upper portion 30 plus the height of the lower portion 35.

Figure 2:
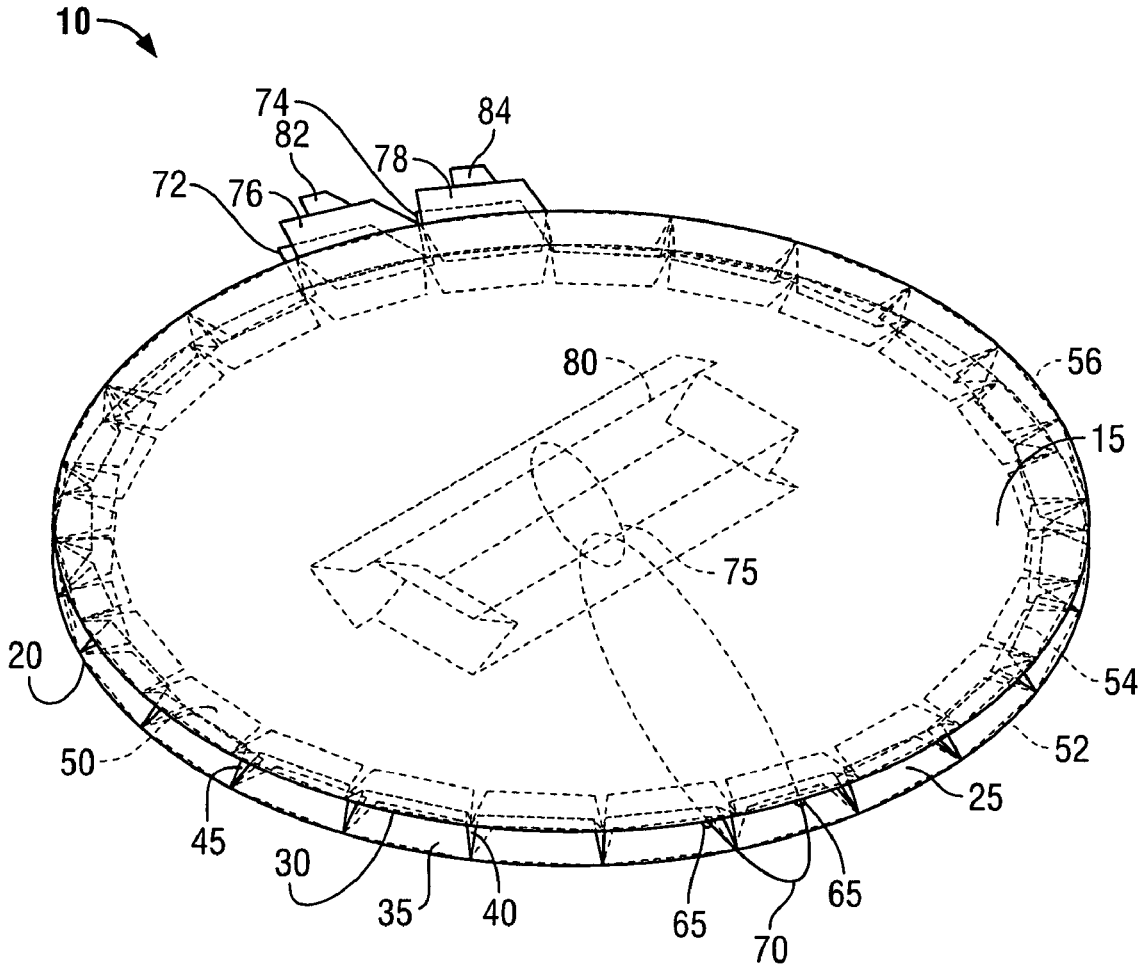
FIG. 2 is a perspective view of the collapsible piñata of FIG. 1 in a position partway between expanded and collapsed.

FIG. 2 shows the piñata 10 in a position partway between expanded and collapsed. In such a position, as well as in a collapsed position, the side panels 25 are folded. In the collapsed position, each upper portion 30 and lower portion 35 is substantially horizontal. The upper portion 30 is folded inwardly about the top hinge-line 56 such that a part of the surface of the upper portion 30 that faces inwardly in the expanded position presses upwardly against the top flap 50. The lower portion 35 is folded inwardly about the bottom hinge-line 52 such that a part of the surface of the lower portion 35 that faces inwardly in the expanded position presses downwardly against the bottom flap 60. The surfaces of the upper portion 30 and the lower portion 35 that face outwardly in the expanded position press against each other in the collapsed position. The central hinge-line 54 is be the inner-most component of the side panel 25.

Figure 4:
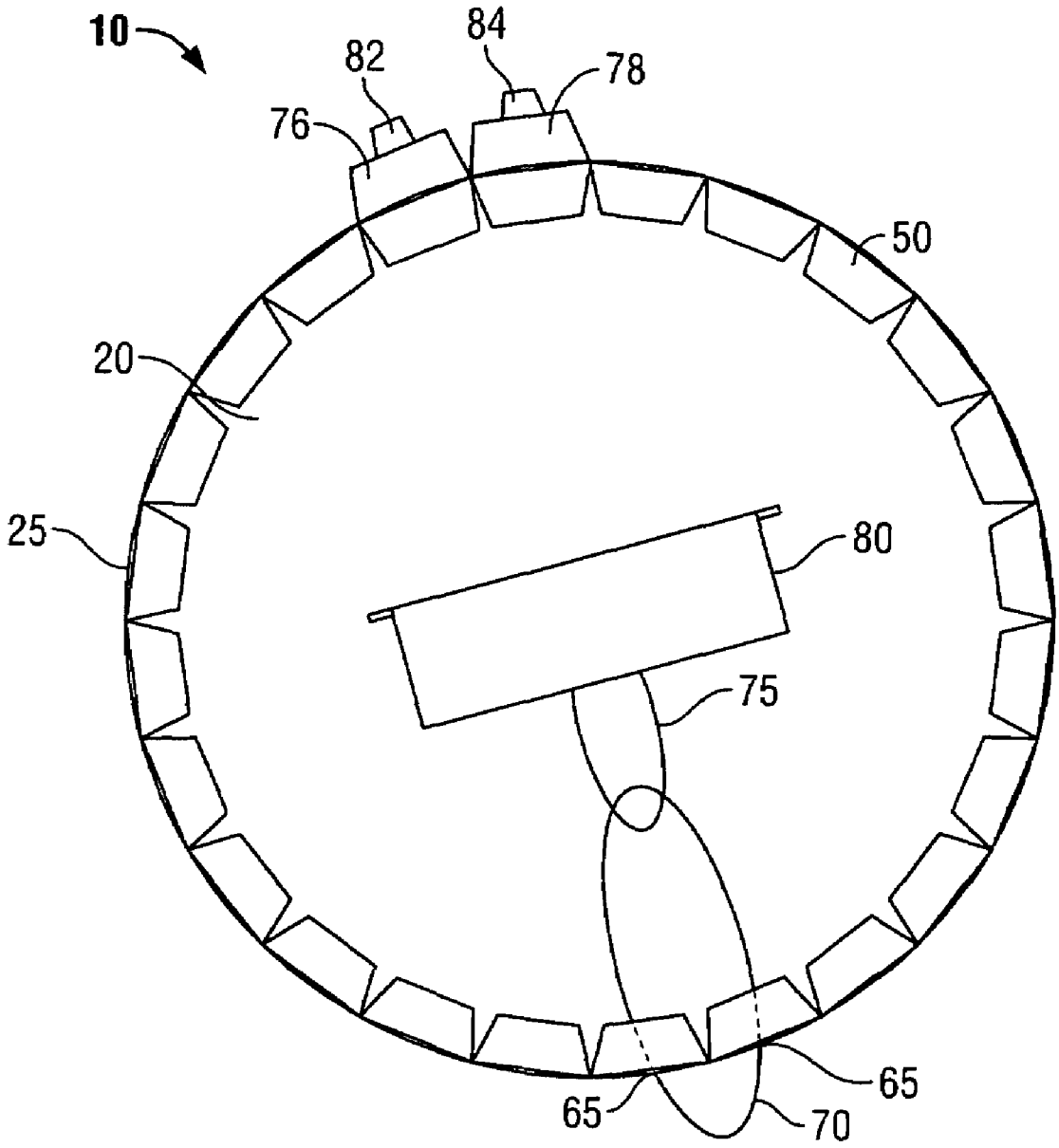
FIG. 4 is a top view of the collapsible piñata of FIG. 1 with a top main panel removed.

As shown most clearly in FIG. 4, the side panels 25 are arranged to form a regular polygon with twenty-four sides. As shown most clearly in FIG. 1, the longer parallel edges of the upper portions 30 are contiguous with one another, and the longer parallel edges of the lower portions 35 are also contiguous with one another. In the collapsed position, the lower portions 35 lay flat against the bottom flaps 45, the top portions 30 lay flat against the lower portions 35, and top flaps 50 lay flat against the top portions 30. No member of one side panel 25 overlaps with a member of another side panel 25 in the collapsed position. The trapezoidal shapes of the upper portion 30 and the lower portion 35 accommodate both of those features—contiguous top and bottom edges in the expanded position and non-overlapping side panels 25 in the collapsed position. As such, in the expanded position, two adjacent side panels 25 define a gap 40 between them. Because the upper portion 30 and the lower portion 35 are trapezoidal in shape, the gap 40 is diamond-shaped. Side panels 25 that define oval-shaped gaps 40 would also provide contiguous top and bottom edges and would not overlap in the collapsed position. Other gap shapes are also possible.

In some embodiments, the top and bottom edges are not continuous and the collapsed side panels are not overlapping. In such embodiments, side panels may be configured in various ways. For example, in some embodiments, the upper portions 30 and the lower portions 35 may be rectangular. The top flaps 50 and/or bottom flaps 45 may be contiguous. The upper portions 30 may combine with the lower portions 35 to form hour-glass-shaped side panels 25. Such embodiments may have contiguous top and/or bottom edges. In some embodiments, adjacent side panels 25 may be offset from each other. One side panel 25 may attach to the edges of the top panel 15 and the bottom panel 20, and the next side panel 25 may attach to the top panel 15 and the bottom panel 20, for example, an inch closer to the center of the piñata 10. The side panels 25 may alternate such that the first side panel 25 attaches to the edge, the second side panel 25 attaches one inch from the edge, the third side panel 25 attaches to the edge, and so on. In some embodiments, multiple side panel designs may be implemented. For example, half of the side panels 25 may be one shape and the other half of the side panels 25 may be another shape. In such embodiments, the side panels 25 may be designed such that each side panel 25 is different from the other side panels 25.

In embodiments in which the top panel 15 and the bottom panel 20 are designed in shapes other than circles, the side panels 25 may accordingly be configured differently. In such embodiments, the side panels 25 may be arranged such that the side panels 25 attach to the edges of the top panel 15 and the bottom panel 20. In such embodiments, some of the side panels 25 may be configured differently than the others. For example, if the top panel 15 and the bottom panel 20 are squares, the side panels 25 near the corners may be shaped differently than the side panels 25 in the middle of the line segments. In this example, the side panels 25 in the middle of the line segments may be designed to minimize the area of the gap 40, whereas the side panels 25 near the corners may be designed to enable the piñata 10 to collapse to as flat a position as possible.

In some embodiments involving non-circular top panels 15 and non-circular bottom panels 20, the side panels 25 do not attach to the edges of the top panel 15 and the bottom panel 20. In such embodiments, the side panels 25 may be arranged in a circle or other shape that permits the side panels 25 to be uniformly configured. The side panels 25 may attach to the edge of either the top panel 15 or the bottom panel 20, while a portion of the opposite panel extends beyond the side panels 25. In some embodiments, the side panels 25 may attach to the top panel 15 at a position inward from the edge and to the bottom panel 20 at a position inward from the edge. A portion of both the top panel 15 and the bottom panel 20 may extend beyond the side panels 25.

In some embodiments, reinforcement members may be implemented in conjunction with the side panels 25. Such reinforcement members may include vertical strips that span the top panel 15 and the bottom panel 20. The strips may be made of any of the materials described herein or any combination thereof. The strips may attach to the inside surface of either the upper portion 30 or the lower portion 35. In such embodiments, when the piñata 10 is in the collapsed position, the strips may lay flat between the top panel 15 and the bottom panel 20. As the piñata 10 expands, and the portion to which the strip is attached becomes increasingly vertical, the strip also becomes increasingly vertical. In the expanded position, the strips lodge between the top panel 15 and the bottom panel 20 such that one end of the strip abuts the top panel 15 and the other end of the strip abuts the bottom panel 20. Such strips may provide added resistance in the event the top panel 15 and the bottom panel 20 are subject to a compressive force.

Some embodiments may include one or more components designed to cover the gaps 40 when the piñata 10 is in an expanded position. In use, the piñata 10 may be filled with candy or other treats. A separate panel may be provided that extends around the perimeter of the top panel 15 and the bottom panel 20 and covers the gaps 40. For example, an elongate strip, made of any of the materials disclosed herein or any other suitable material, may be provided. The elongate strip may have a length approximately equal to the perimeter of the top panel 15, the bottom panel 20, or both. The elongate panel may be affixed by a user against the outer edge of the top panel 15, the bottom panel 20, or both. The elongate panel may have a width approximately equal to the distance between the top panel 15 and the bottom panel 20. The elongate panel may optionally attach to the side panels 25. One end of the elongate panel may attach to the opposing end of the elongate panel. The elongate panel may be weaved between side panels 25. Other components that may be designed to cover gaps 40 include ornamentation, such as is described above, and other suitable material. Reinforcement members, such as those described herein, may be implemented to fill gaps 40 when the piñata 10 is in an expanded position.

The piñata 10 of FIGS. 1-4 includes two upper doors 76, 78 and two lower doors 72, 74. The upper doors 76, 78 are the same shape as the upper portions 30, and the lower doors 72, 74 are the same shape as the lower portions 35. The upper doors 76, 78 meet respective top flaps 50 along top hinge-lines 56. The lower doors 72, 74 meet respective bottom flaps 45 along bottom hinge-lines 52.

The upper doors 76, 78 and the lower doors 72, 74 are shown in an open position. When the upper doors 76, 78 and the lower doors 72, 74 are in an open position, a user may fill the piñata 10 with candy or other treats. When the piñata 10 is sufficiently filled, the user may close the upper doors 76, 78 and the lower doors 72, 74. The user may close the upper doors 76, 78 by folding the upper doors 76, 78 downwardly about the top hinge-line 56 until the angle between the top flap 50 and the upper doors 76, 78 approximates the angle between the top flap 50 and the upper portions 30. The user may close the lower doors 72, 74 by folding the upper doors 72, 74 downwardly about the bottom hinge-line 52 until the angle between the bottom flap 45 and the lower doors 72, 74 approximates the angle between the bottom flap 45 and the lower portions 35. The upper doors 76, 78 and the lower doors 72, 74 may be secured in a closed position by adhesive strips 82, 84. The adhesive strips 82, 84 may include a peelable release liner. The upper doors 76, 78 and the lower doors 72, 74 may be secured in a closed position by a single piece of adhesive that covers at least a portion of all of the doors. The upper doors 76, 78 and the lower doors 72, 74 may be secured in a closed position by a tab and slot configuration. Many methods of securing the upper doors 76, 78 and the lower doors 72, 74 in a closed position may be implemented.

Various mechanisms for allowing a user to fill the piñata 10 may be implemented. For example, instead of two upper doors 76, 78 and two lower doors 72, 74, one upper door and one lower door may be implemented. Any number of appropriate doors may be implemented. The doors may open inwardly rather than outwardly. In some embodiments, a full side panel 25 may serve as a door. The side panel 25 may swing open about the top hinge-line 56 or the bottom hinge-line 52. In such embodiments, one side panel 25 may swing open about the top hinge-line 56, and another side panel 25 may swing open about the corresponding bottom hinge-line 52, such that, in a closed position, the two side panels 25 form a double-layer to cover the opening. In some embodiments, users may fill the piñata 10 through openings in the top panel 15, the bottom panel 20, or both. In such embodiments, the openings may be covered before the piñata 10 is used.

Figure 6A:
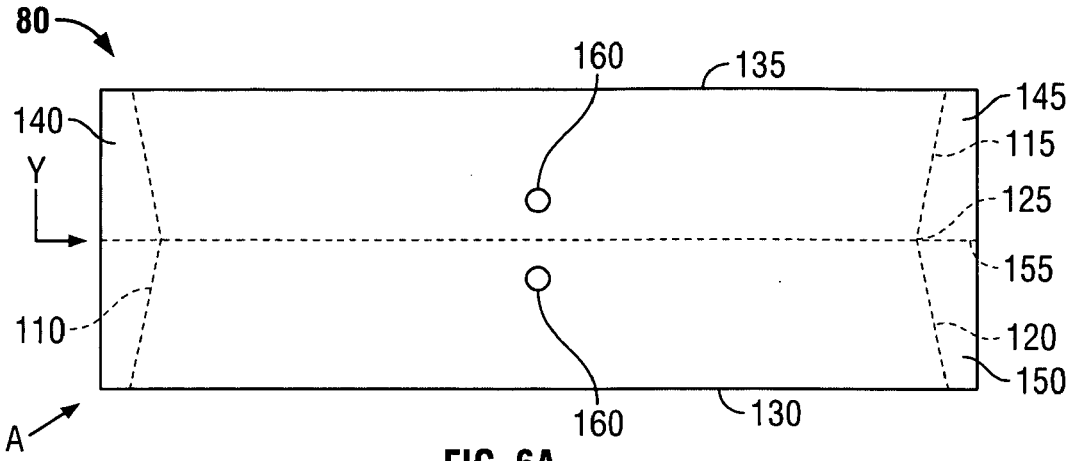
FIG. 6A is a top view of an expansion mechanism in an expanded position.
Figure 6B:
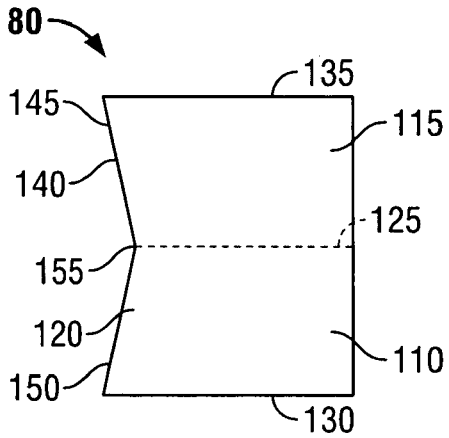
FIG. 6B is a side view of the expansion mechanism of FIG. 6A.
Figure 6C:
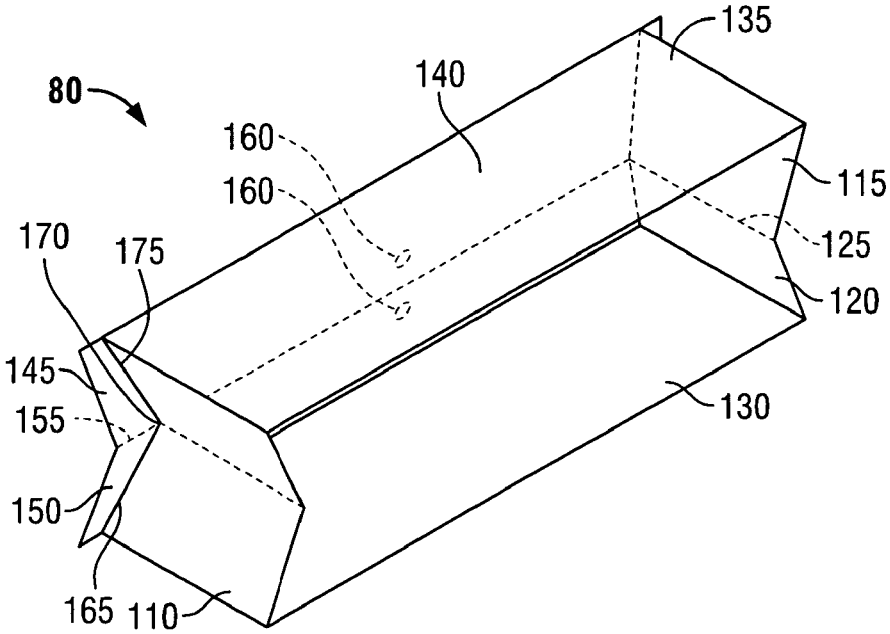
FIG. 6C is a perspective view of the expansion mechanism of FIG. 6A.

The piñata 10 shown in FIGS. 1-4 includes an expansion mechanism 80. The expansion mechanism 80 may be made of any of the materials described herein or of any other suitable material. The expansion mechanism 80 is shown in greater detail in FIGS. 6A-6C. FIGS. 6A-6C show the expansion mechanism 80 in an expanded position. The expansion mechanism 80 includes a top member 135, a bottom member 130, two side members 110, and cap member 140. The components of the expansion mechanism 80 may be integrally formed of the same material. The top member 135 may be attached to the top panel 15 in any of the ways described herein or in any other suitable way. The bottom member 130 may be attached to the bottom panel 20 in any of the ways described herein or in any other suitable way. Each side member 110 includes an upper portion 115 and a lower portion 120. In some embodiments, the upper portion 115 includes a fold that attaches to the top panel 15, and the lower portion includes a fold that attaches to the bottom panel 20. In such embodiments, the top member 135 and the bottom member 130 may be omitted, and the cap member 140 may be attached to the top panel 15 and the bottom panel 20 by flaps. The upper portion 115 meets the lower portion 120 along a central hinge-line 125. The longer edges of the cap member 140 attach to the top member 135 and the bottom member 130. The cap member 140 includes an upper segment 145 and a lower segment 150. The upper segment 145 meets the lower segment 150 along a middle hinge-line 155. The cap member 140 defines two apertures 160 through which a loop may pass. FIGS. 1-2 show how a loop 75 may be implemented in conjunction with an expansion mechanism.

Referring to FIGS. 1-3 and to FIGS. 6A-6C, the top member 135 of the expansion mechanism 80 attaches to the interior surface of the top panel 15. The bottom member 130 of the expansion mechanism 80 attaches to the interior surface of the bottom panel 20. As shown, the central hinge-line 125 and the middle hinge-line 155 of the expansion mechanism 80 are substantially co-planar with the central hinge-line 54 of the side panels 25.

FIG. 1 shows the expansion mechanism 80 in an expanded position. In a collapsed position, the expansion mechanism 80 may be folded substantially flat between the top panel 15 and the bottom panel 20. Referring to FIGS. 6A-6C, the cap member 140 may be folded outwardly such that the middle hinge-line 155 points away from the interior of the expansion mechanism 80. The side members 110 may be folded inwardly such that the central hinge-line 125 points toward the interior of the expansion mechanism 80. The side members 110 may be folded outwardly such that the central hinge-line 125 points toward the exterior of the expansion mechanism 80. One side member 110 may be folded inwardly such that the central hinge-line 125 points toward the interior of the expansion mechanism 80, and the other side member 110 may be folded outwardly such that the central hinge-line 125 points toward the exterior of the expansion mechanism 80. A loop (such as that shown as 75 in FIGS. 1-4) may pass through apertures 160.

Referring to FIGS. 2 and 6C, to activate the expansion mechanism 80, a tensile force may be exerted on the loop 75. The tensile force may be applied by a second loop 70. The second loop 70 passes through the opening defined by the first loop 75. The second loop 70 extends beyond the side panels 25 and passes through apertures 65. A user may pull on the second loop 70, which would exert a tensile force on the first loop 75. Such tensile force may cause both the upper segment 150 and the lower segment 150 to move toward the interior of the expansion mechanism 80. As the upper segment 150 and the lower segment 150 move toward the interior of the expansion mechanism 80, the angle between the upper segment 150 and the lower segment 150 increases. The top member 135 and the bottom member 130 are pressed apart and the angle between the top member 115 and the bottom member 120 likewise increases. FIG. 2 shows a piñata 10 in such an intermediate position, between collapsed and expanded states.

Other handles with which a user may actuate the expansion mechanism 80 may be implemented. For example, one loop may be coupled to the expansion mechanism 80 and may extend beyond the side panels 25. In some embodiments, a thin strip of corrugated cardboard or other suitable material may serve as the handle or pull member. In some embodiments, the handle may comprise a relatively rigid member, with which a user may push the upper segment 150 and the lower segment 150 toward the interior of the expansion mechanism 80.

Referring to FIGS. 6A-6C and FIGS. 1-2 when the top member 140 is pulled inwardly to a position in which both the upper segment 150 and the lower segment 150 are substantially vertical (i.e., when the angle between the upper segment 150 and the lower segment 150 is approximately 180°), the expansion mechanism 80 presses the top panel 15 away from the bottom panel 20. This exerts a tensile force on side panels 25. When the top member 140 is pulled beyond the position in which the upper segment 150 and the lower segment 150 are substantially vertical, the side panels 25 may exert a compressive force on the top panel 15 and the bottom panel 20. As a result, the top member 135 and the bottom member 130 are pressed together, causing the top member 140 to fold inwardly to the expansion mechanism 80. Before the top member 140 can fold inwardly to a flat position, the side members 110 engage the top member 140. The upper portions 115 of the side members 110 engage the upper segment 150 of the cap member 140 along an upper interface 175. The lower portions 120 of the side members 110 engage the lower segment 150 of the cap member 140 along a lower interface 165. The central hinge-line 125 may interface with the middle hinge-line 155 at an interface point 170. The side members 110 may hold the cap member 140 in place, which maintains the piñata 10 in an expanded position during use.

Although two side members 110 are shown, any suitable number of side members may be implemented. For example, a single side member may be located approximately midway between where the side members 110 are depicted in FIGS. 6A-6C so as to engage the cap member 140. Each side member 110 may be folded inwardly or outwardly. The expansion mechanism may be in a substantially irreversibly expanded position such that a tensile force must be exerted on the cap member 140 toward the exterior of the expansion mechanism 80 in order to collapse the expansion mechanism 80. When the cap member 140 moves past vertical, the cap member 140 may be pressed flat such that the middle hinge-line 155 extends away from the interior of the expansion mechanism 80.

In some embodiments, multiple expansion mechanisms may be implemented. The expansion mechanisms may be positioned to distribute the load involved in pressing the top panel 15 away from the bottom panel 20 optimally. In such embodiments, the multiple expansion mechanisms may be actuated by a single tensile force. A tensile member may be coupled to each of the expansion mechanisms, and each of the tensile members may be coupled to a single tensile member. When the single tensile member is subjected to a tensile force, each of the expansion mechanisms may expand.

When in an expanded position, the piñata may be ready for use. The piñata may be suspended in various ways, such as by connecting a string or wire between the piñata and a fixed object, such as a tree branch. Some embodiments may include several pull-strings. Some of the pull-strings may be detachable (i.e., dummy strings) and one or more pull-strings may be connected to a trap door.

Figure 7A:
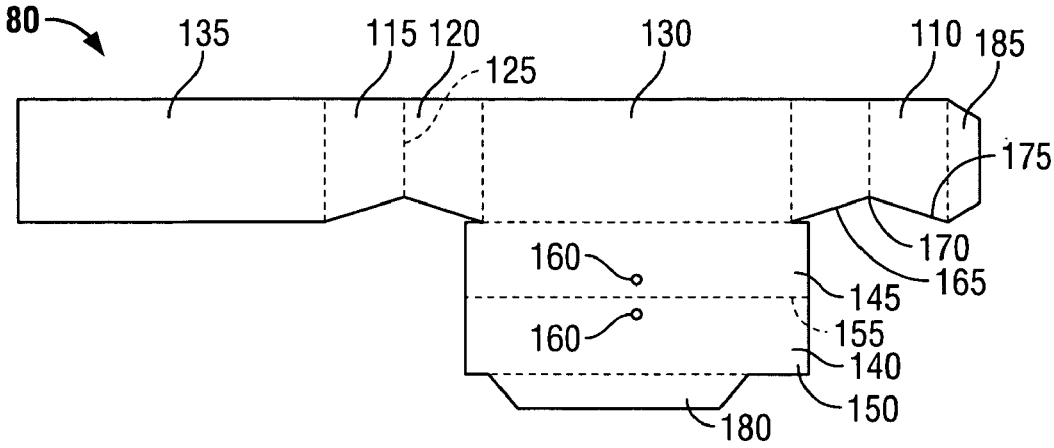
FIGS. 7A-7D are assembly views of an expansion mechanism.

FIGS. 7A-7F show the exemplary expansion mechanism 80 of FIGS. 1-4. The assembly process depicted in FIGS. 7A-7F is also exemplary. The steps involved in constructing this embodiment may be performed in any appropriate order. FIG. 7A shows the expansion mechanism 80 in a disassembled state. The expansion mechanism may be integrally formed of any of the materials disclosed herein or of any other appropriated material.

Figure 7B:
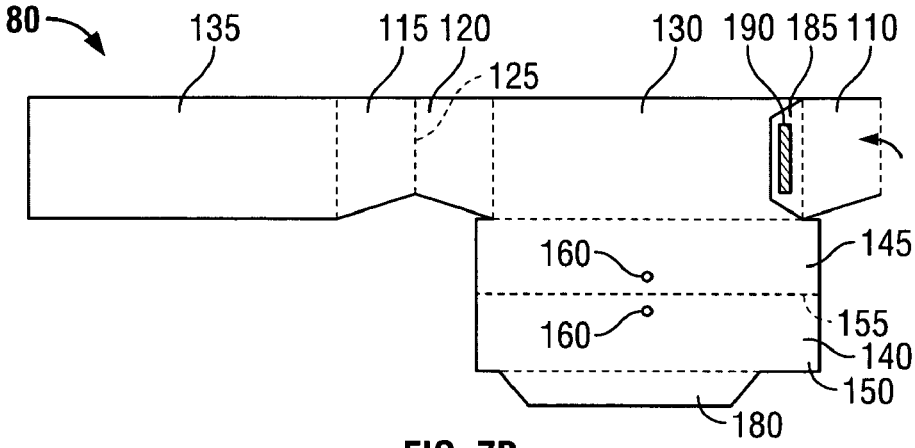
Figure 7C:
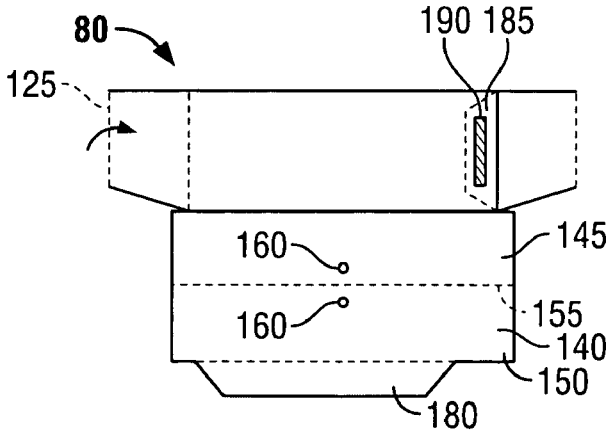

FIG. 7B shows the first step of assembling the expansion mechanism 80. The side member 110 is folded along the central hinge-line 125 such that the side member 110 is folded outwardly. FIG. 7C illustrates the second step of assembling the expansion mechanism 80. Side member portions 115 and 120 are folded along the central hinge-line 125 such that top member 135 rests atop bottom member 130. Flap 185 contacts the interior or exterior surface of the tip member 135, and an adhesive strip 190 secures the flap 185 to the top member 135.

Figure 7D:
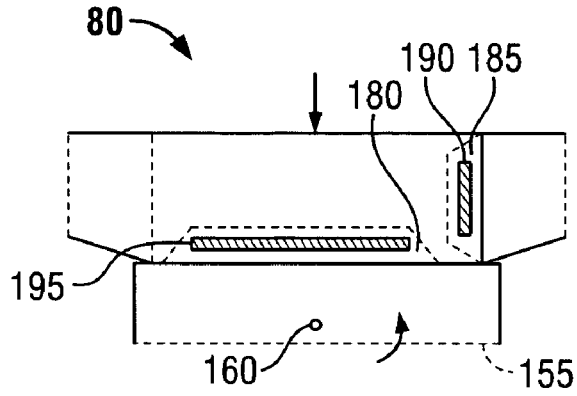
Figure 7E:
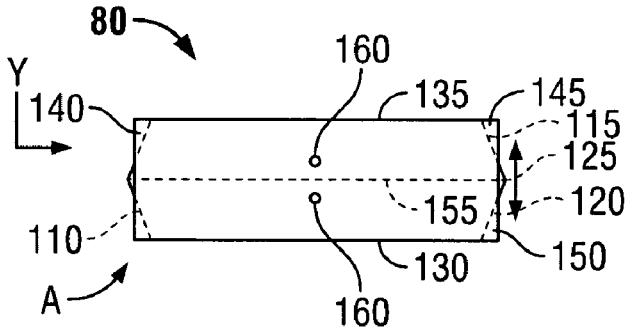
FIGS. 7E-7F are views of the expansion mechanism of FIGS. 7A-7D in operation.

FIG. 7D illustrates the third step of assembling the expansion mechanism 80. The cap member 140 is folded outwardly. A flap 180 contacts the interior or exterior surface of the top member 135, and an adhesive strip 190 secures the flap 180 to the top member 135. Turning to FIG. 7E, the expansion mechanism 80 is rotated 90° about the horizontal axis The expansion mechanism 80 is partially expanded, and the end members 110 are folded outwardly. The cap member 140 is folded outwardly.

Figure 7F:
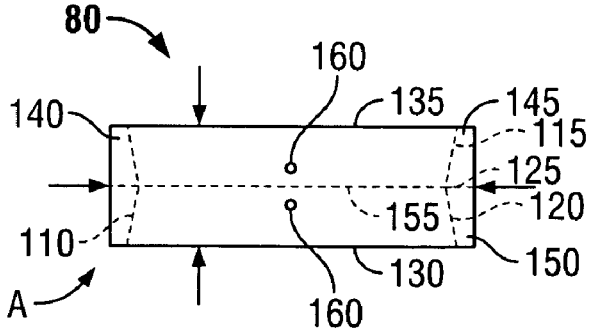

FIG. 7F shows the expansion mechanism 80 in a fully expanded position. The end members 110 are folded inwardly. The cap member 140 is folded inwardly and is engaged by the end members 110. The cap member 140 is prevented from folding flat by the end members 110. As such, the expansion mechanism 80 remains in an expanded position. The expansion mechanism 80 remains in this expanded position substantially irreversibly in the absence of a force sufficient to fold the cap member 140 outwardly.

The panels described herein may comprise various materials. The top panel may be constructed of a different material than the bottom panel and/or the side panels. Embodiments that are constructed of corrugated cardboard may be designed in various ways. For example, the corrugated cardboard may be implemented with various flute profiles, weights, thicknesses, colors, and numbers of walls.

A number of embodiments have been described. Nevertheless, it will be understood that various modifications may be made and that other embodiments are within the scope of the following claims.

What is claimed is:

1. A collapsible piñata construction comprising:

first and second main panels each having a perimeter edge;

a plurality of foldable side panels spanning between the first and second main panels and maintaining the first and second main panels in generally parallel spaced apart relation;

one or more access doors to provide access to a candy-receiving space defined between the first and the second main panels when the first and second main panels are in an expanded condition; and an expansion mechanism to move the side panels between a first position in which the side panels are folded and a second position in which the side panels are unfolded so that the candy-receiving space is defined between the first and second main panels, the expansion mechanism being located between the first and second main panels, and being spaced inward and apart from the perimeter edge of the first and second main panels and all the foldable side panels.

2. The collapsible piñata construction of claim 1, wherein the expansion mechanism is operable to expand when a single tensile force is applied to a tensile member coupled to the expansion mechanism, wherein the collapsible piñata construction fully expands to define the candy-receiving space between a parallel arrangement of the first and second main panels in response to the application of the single tensile force.

3. The collapsible piñata construction of claim 1, wherein the expansion mechanism comprises:

a top planar face and a bottom planar face, wherein the top planar face is affixed to an inner surface of the first main panel, and the bottom planar face is affixed to an inner surface of the second main panel;

first and second foldable end panels spanning between the top and bottom planar faces; and a foldable actuation panel spanning between the top and bottom planar faces, wherein the actuation panel is folded away from the end panels in the first position, and wherein the actuation panel is operable to be urged toward the end panels until the actuation panel is engaged by the end panels in the second position.

4. The collapsible piñata construction of claim 1, wherein the expansion mechanism expands substantially irreversibly when a tensile force is applied to a tensile member coupled to the expansion mechanism so as to hold the side panels in the second position.

5. The collapsible piñata construction of claim 1, wherein the expansion mechanism includes at least one aperture and a handle received in the at least one aperture, the handle being operable to urge the expansion mechanism to move the side panels from the first position to the second position when the handle is subjected to a tensile force.

6. The collapsible piñata construction of claim 1, wherein the side panels include at least one aperture being adapted to receive a handle, the handle being operable to urge the expansion mechanism to move the side panels from the first position to the second position when the handle is subjected to a tensile force.

7. The collapsible piñata construction of claim 1, wherein, in the second position, adjacent side panels define a gap therebetween.

8. The collapsible piñata construction of claim 1, wherein the perimeter edge of the first and second main panels define one of a rectangular, square, oval and triangular shape.

9. The collapsible piñata construction of claim 8, wherein the side panels are adhered to both the first and second main panels.

10. The collapsible piñata construction of claim 1, wherein the one or more access doors are arranged adjacent to the foldable side panels to provide side access to the candy-receiving space.

11. A collapsible construction method comprising:

receiving a collapsible piñata structure comprising: first and second main panels having a perimeter edge, one or more access doors to provide access to a candy-receiving space defined between the first and the second main panels when the first and second main panels are in an expanded position, and an expansion mechanism to move the first and second main panels from a first position to the expanded position, the expansion mechanism being located between the first and second main panels, and being spaced inward and apart from the perimeter edge of each of the first and second main panels;

actuating the expansion mechanism with a single tensile force applied to a tensile member coupled to the expansion mechanism so as to adjust the first and second main panels of the collapsible piñata structure to the expanded position in which the first and second main panels are generally parallel to one another; and inserting items through the one or more access doors into the candy-receiving space.

12. The method of claim 11, wherein the step of inserting items comprises inserting one or more of candy and small toys into the candy-receiving space.

13. The method of claim 11, wherein the step of actuating comprises applying the tensile force on a loop coupled to the expansion mechanism.

14. The method of claim 11, wherein the collapsible piñata structure further comprises a plurality of foldable side panels spanning between the first and second main panels and maintaining the first and second main panels in generally parallel spaced apart relation when the first and second main panels are moved to the expanded position.

15. The method of claim 14, wherein the perimeter edge of the first and second main panels define one of a rectangular, square, oval and triangular shape.

16. The method of claim 14, wherein the side panels are adhered to both the first and second main panels.

17. The method of claim 14, wherein the one or more access doors are arranged adjacent to the foldable side panels to provide side access to the candy-receiving space.

* * * * *

UNITED STATES PATENT AND TRADEMARK OFFICE

CERTIFICATE OF CORRECTION

PATENT NO. : 7,648,059 B2
APPLICATION NO. : 10/889664
DATED : January 19, 2010
INVENTOR(S) : Pavlu, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1246 days.

Signed and Sealed this

Sixteenth Day of November, 2010

David J. Kappos

David J. Kappos
*Director of the United States Patent and Trademark Office*